United States Patent [19]

Castelluzzo

[11] Patent Number: 4,517,741

[45] Date of Patent: May 21, 1985

[54] KNIFE WITH PLURAL REPLACEABLE BLADE STORAGE AND MEANS FOR SINGLE BLADE EXTENSION

[76] Inventor: James M. Castelluzzo, 188 Avenue of the Americas, New York, N.Y. 10013

[21] Appl. No.: 379,900

[22] Filed: May 19, 1982

[51] Int. Cl.[3] ..... B26B 21/24; B26B 1/08

[52] U.S. Cl. ..... 30/162; 30/335

[58] Field of Search ..... 30/40, 162, 293, 335

[56] References Cited

U.S. PATENT DOCUMENTS

| | | | |
|---|---|---|---|
| 2,172,072 | 9/1939 | Rothschild | 30/335 |
| 2,967,354 | 1/1961 | Ahlborn | 30/293 |
| 3,577,637 | 5/1971 | Bragimetz | 30/162 |
| 3,660,896 | 5/1972 | Umholtz | 30/162 |
| 3,708,881 | 1/1973 | Bennett | 30/335 |
| 4,005,525 | 2/1977 | Gringer | 30/335 |
| 4,242,795 | 1/1981 | Rollband | 30/162 |
| 4,277,888 | 7/1981 | Szabo | 30/162 |

*Primary Examiner*—E. R. Kazenske
*Assistant Examiner*—Paul M. Heyrana
*Attorney, Agent, or Firm*—Thomas R. Morrison

[57] ABSTRACT

A knife having generally thin, relatively inexpensive and replaceable blades which can be extended from the handle when the knife is to be used and can be retracted when the knife is to be stored, the knife having a cavity in the handle for receiving a stack of the blades, a slide having a magnetic face for engaging and sliding the innermost blade into extended position and for retracting the blade into the handle and a lock for locking the blade extended.

4 Claims, 14 Drawing Figures

KNIFE WITH PLURAL REPLACEABLE BLADE STORAGE AND MEANS FOR SINGLE BLADE EXTENSION

This invention relates to knives having generally thin, relatively inexpensive and replaceable blades which can be extended from the handle when the knife is to be used and can be retracted into the handle when the knife is to be stored. More particularly, this invention relates to utility knives, knives for surgery, arts and crafts and other knives where a sharp replacement blade, which is readily available, with minimum of delay and manipulation, when the blade in used is damaged or becomes dull, is desired.

Various attempts have, heretofore, been made to provide a utility knife with slidable, replaceable blades. One such attempt is described in U.S. Pat. No. 3,660,896, dated May 9, 1972, wherein a stack of single edge, relatively thin blades are inserted into a handle, are spring pressed toward a slide and the innnermost blade is engaged by a spring pressed slide which extends, retracts and locks the blade in extended position. In the arrangement of such patent, the blade stack is spring pressed along a guide or pin which engages a recess or notch in the blades and holds the blades in the stack in contact with the slide. The innermost blade is spring pressed off of the blade stack guide or pin and is engaged by a pin on the slide. The slide pin engages the recess or guide in the innermost blade so that such blade slides in the handle with the slide to extend, lock the blade in the extended position and to retract the blade.

One of the difficulties with arrangement of the '896 patent is in the feed, alignment and guide of the blades. As the blades in the utility knife of the patent are used and ejected, the tension on the spring feeding the following blades changes. Such springs, after continual use, tend to lose their tension, the blades become misaligned and jam and such knife becomes undependable.

In the instant invention, many of the problems and disadvantages of the spring fed utility knife are overcome and the reliability and dependability of the knife is substantially improved. This is accomplished, in the instant invention, by magnetically engaging the innermost of the blades of the blade stack with the slide and, with the magnet and a blade follower movable with the slide, advancing the innermost blade in the blade guide to project the end of the blade from the handle. When projected, the blade in the instant invention is then locked independent of the slide. Thus, forces applied to the blade while the blade is in use are transmitted to the handle independent of the slide. Wear and damage to the slide are avoided.

The blade in the knife of the instant invention can be unlocked, the blade can be retracted into the handle, the used blade can be rejected and the rejected blade can be reversed and reinserted into the knife by either re-inserting the reversed blade in the blade guide and re-locking the re-inserted blade or by adding the reversed blade to the top of the stack of blades in the handle. In those instances where the used blade is to be replaced during use, it may be preferred to reject the used blades while the knife is in use and to collect, reverse, and restack the used blades in the handle, with the unused, good blade end in the forward position after use of the knife is finished and before the knife is re-used.

The instant invention will be more fully described and better understood from the following description of a preferred embodiment of the invention taken with the appended drawings in which FIG. 1 is a perspective view of the knife of the instant invention shown with the blade extended;

Figure 1:
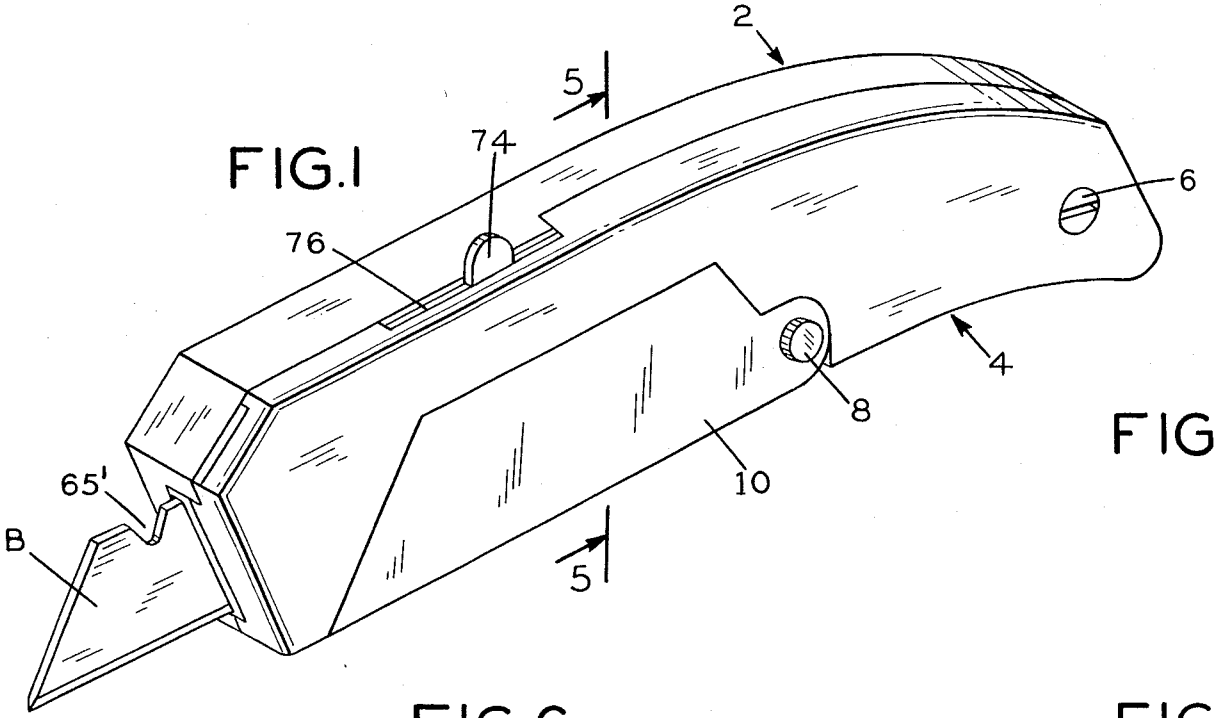
Figure 5:
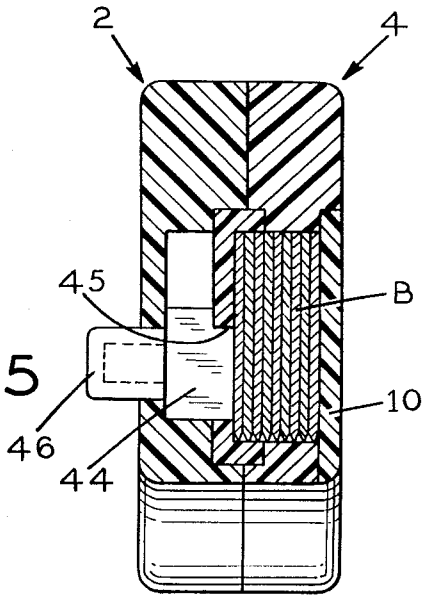
FIG. 5 is a sectional view taken at 5—5 FIG. 1.

Referring to the drawings, the handle is made up of two mating parts, generally designated 2, 4, held assembled around a blade guide and blade slide, as will be later described, by through bolts 6, 7. Bolt 8 acts as a pivot for blade cavity cover 10. Handle parts 2, 4 and cover 10 may be of metal, wood, plastic or any other suitable material and, preferably are molded from plastic with suitable recesses to accommodate the parts, as will be described, and with relief areas to reduce weight and costs. Handle part 2 has a slot 3, FIG. 9, for purposes described.

Figure 2:
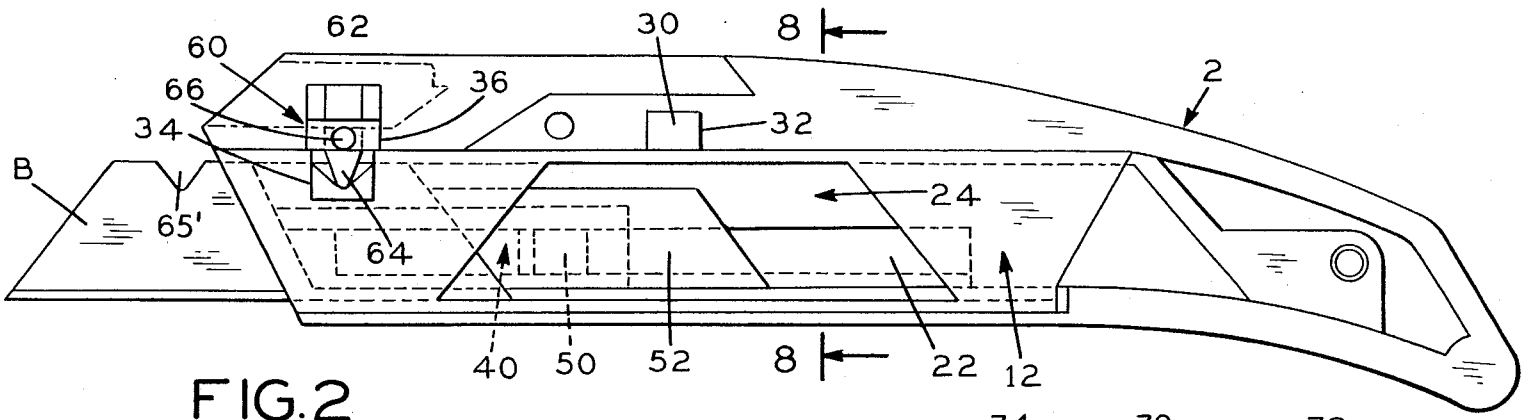
FIG. 2 is a side view of the knife of FIG. 1 with one side of the handle body removed.
Figure 3:
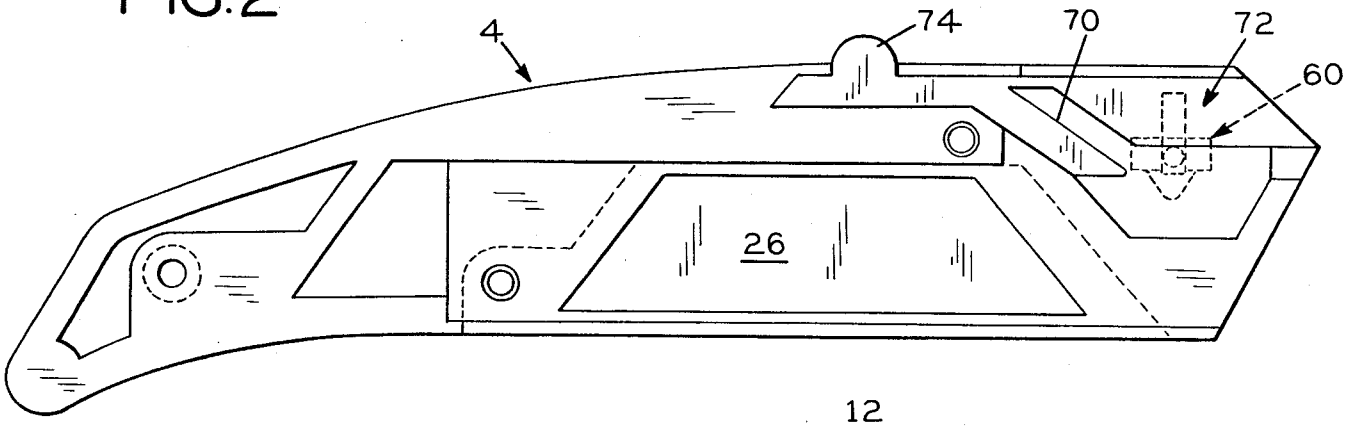
FIG. 3 is a side view from the opposite side of the knife of FIGS. 1 and 2 with one side of the handle body removed.
Figure 4:
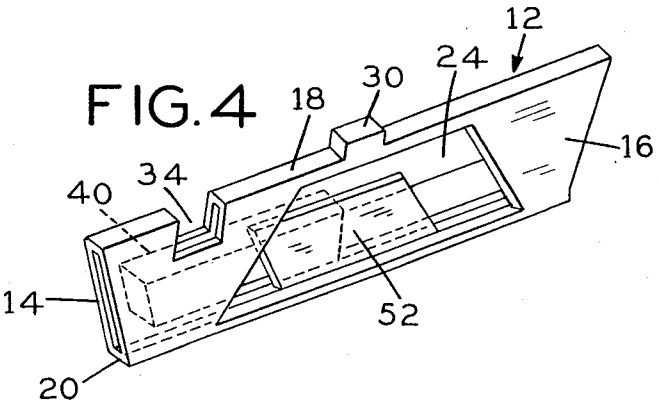
FIG. 4 is a perspective of the blade guide and blade slide of the knife assembly.
Figure 9:
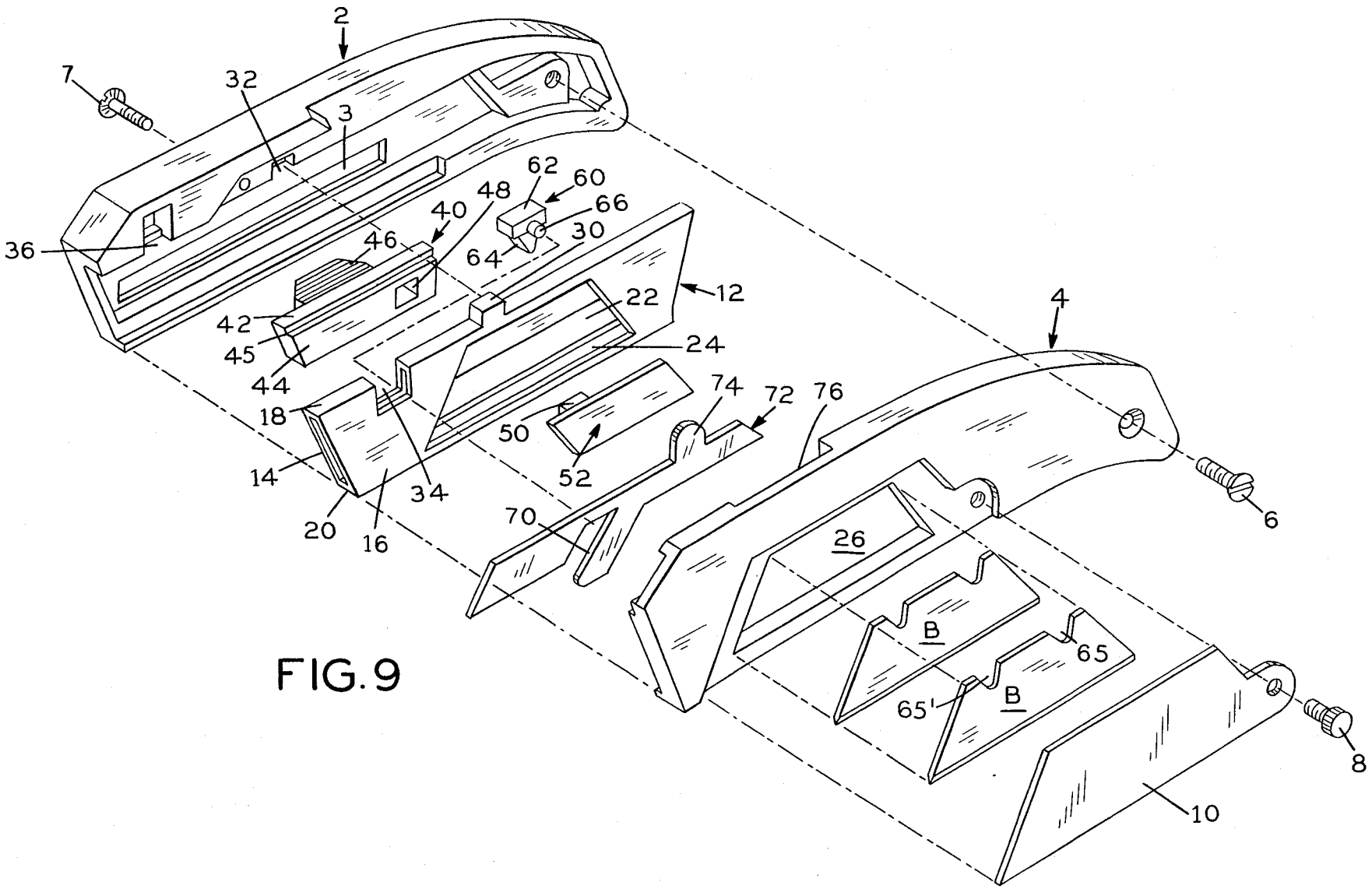
FIG. 9 is an exploded view, in perspective, of the knife of FIG. 1.

As best shown in the embodiment of FIGS. 2, 4, and 9, blade guide, generally designated 12, has side walls 14, 16 and top and bottom walls 18, 20. Blade guide side wall 14 has a slot 22 for purposes later described. Blade guide side wall 16 has a trapezoidal opening 24 which, when the knife is assembled, aligns with trapezoidal opening 26 in housing 4 for receiving blade B. Top wall 18 of blade guide 12, FIGS. 4 and 9, is provided with lug 30 which seats in recess 32 in handle part 2 when the knife is assembled and with cut-out 34 which aligns with cut-out 36 in handle part 2 in the assembly.

Blade slide, generally designated 40, FIG. 9, has a magnetic body 42, magnetic face 44, lip 45, handle 46, and slot 48. Handle 46 slides along handle slot 3 in body part 2, with lip 45 riding along the wall of blade guide slot 22 so that the face of magnetic face 44 is substantially flush with the inner surface of side wall 14, for purposes later described. Lug 50 on blade follower 52 is engaged in slot 48 through slot 22 of blade guide 12 when the knife is assembled and slides in blade guide 12 as blade slide 40 is advanced and retracted in the body cavity of handle part 2 by handle 46.

Blade lock, generally designated 60, FIGS. 2, 3, 6, 7 and 9, has a rectangular body portion 62 which, when the knife is assembled, rides in cut-out 36 of handle part 2, FIG. 9, tapered body portion 64 which, in the embodiment illustrated in FIGS. 1–11, engages in lock groove 65, 65' in blade B and pin 66.

Pin 66 of blade lock 60 is engaged by ramp 70 of lock release 72 slidable in the handle when the knife is assembled by advancing and retracting tab 74 in handle slot 76, FIGS. 1, 6, 7 and 9.

The knife of the instant invention may be designed to house any number and style of blades taking into account the thickness of the blades and the weight and utility of the knife. Because the main utility of the knife of this type is in the blade point, a knife designed for twelve blades provides twenty-four points, twelve points in the direction of the blades initially placed in the housing and twelve points as the blades are reversed.

To load the blades into the knife, cover 10 is pivoted about bolt 8 to expose trapezoidal opening 26 forming the blade cavity and the blades are stacked, one on the other, in the cavity. Cover 10 is then closed. The blades are, of course, of steel and the innermost blade rests on magnetic face 44 of blade slide 40 which is fully retracted in slot 22 of the knife handle.

Figure 7:
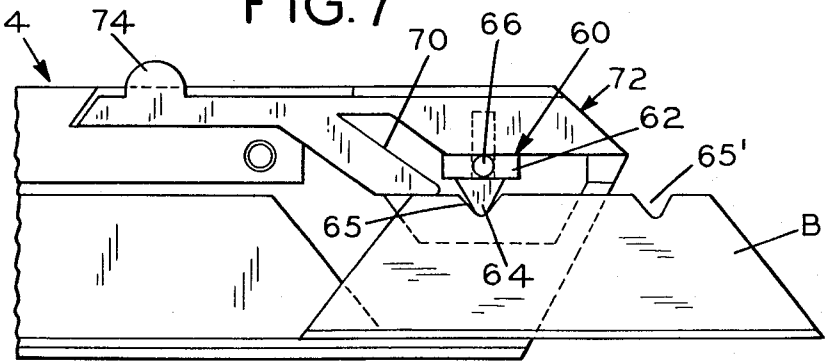
FIG. 7 is a side view, similar to FIG. 6 but showing the lock engaged.
Figure 6:
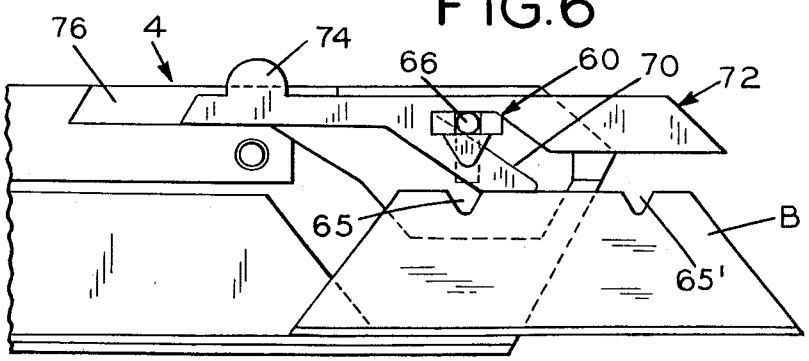
FIG. 6 is a side view, with one side of the handle body removed, showing the lock of one embodiment of the invention disengaged.

The innermost blade resting on magnetic face 44 of blade slide 40 is advanced to project out of the knife handle, as shown in FIGS. 1, 6 and 7 by manually advancing handle 46 in slot 3. Before handle 46 is advanced, retracting tab 74 in handle slot 76 is advanced to release blade lock 60 and allow blade lock 60 to ride up in cut-out 36 so that the blade can be advanced. With the blade advanced, retracting tab 74 is retracted in handle slot 76, allowing tapered body portion 64 to drop into lock groove 65. Lock release 72 is retracted by retracting tab 74 in handle slot 76 locking the blade extended as best shown in FIG. 7, As handle 46 is advanced in slot 3 in body part 2 to advance the innermost blade, blade follower 52 is drawn by blade slide 40 in front of the immediately following blade in the handle preventing the following blade from entering the blade guide and allowing the advanced blade to be retracted and drawn back into the handle when blade lock 60 is released and handle 46 and blade slide 40 are retracted. Blade follower 52 is of ferrous material so that the magnetic attraction of magnetic face 44 holds blade follower 52 in alignment in the blade guide and holds follower lug 50 in blade slide 40.

When the edge of the innermost blade becomes dull or is damaged, lock release 72 can be advanced, with the blade advanced, to release blade lock 60 and the dull or damaged blade can be removed, reversed, reinserted in the handle and relocked or the dull or damaged blade may be removed and discarded.

When the dull or damaged blade is removed and discarded, handle 46 is retracted in slot 3 and blade follower 52 is retracted in the blade guide past the next following blade in trapezoidal opening 26. The handle may be tipped so that the next following blade comes into contact with magnetic face 44 of blade slide 40 or the force of the magnet, itself, draws the next following blade into flat contact with magnetic face 44. The next following blade, in flat contact with magnetic face 44, is now in position to be advanced, locked, unlocked and retracted in the handle as aforesaid.

The foregoing procedures are repeated until all of the blades are used. The blades might then be replenished in the handle or blades might be added before the supply is exhausted.

Modifications of the apparatus of the instant invention are shown in FIGS. 10–14.

Figure 10:
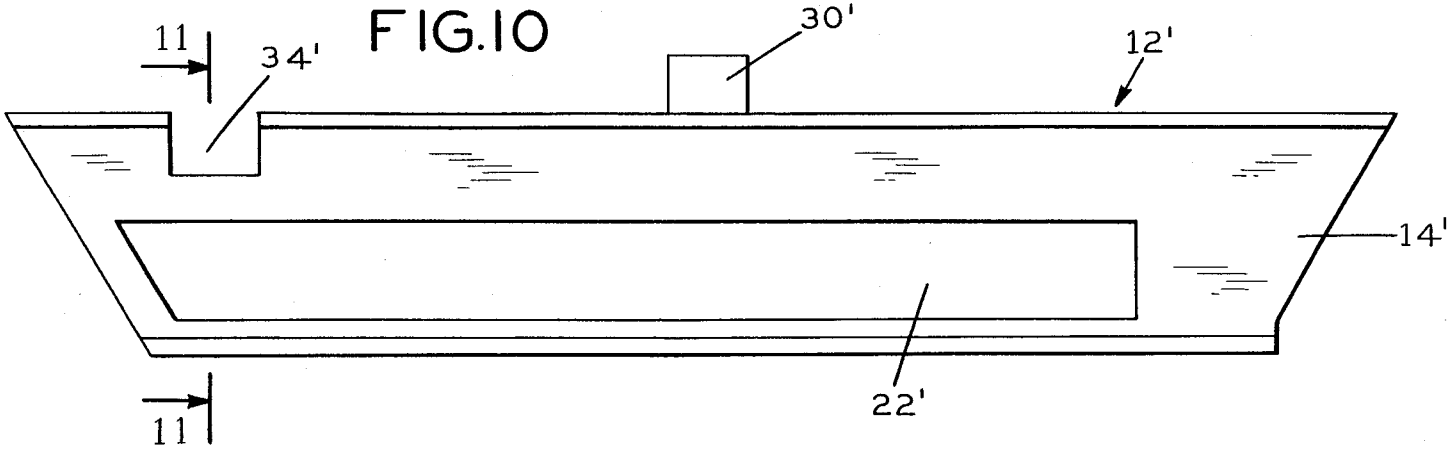
FIG. 10 is a side view of a modified blade guide for use in one embodiment of the invention.
Figure 11:
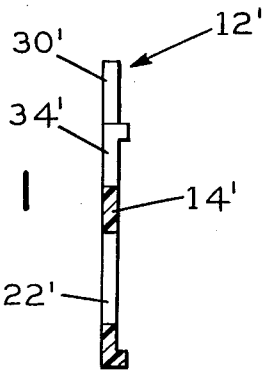
FIG. 11 is a sectional view taken at 11—11 FIG. 10.
Figure 8:
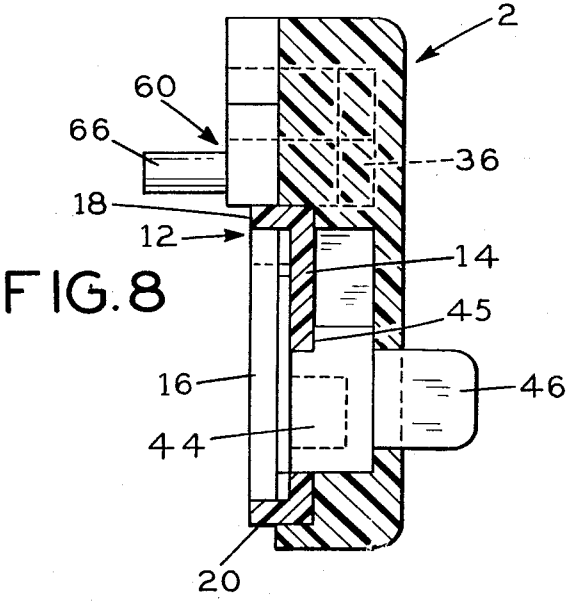
FIG. 8 is a sectional view taken at 8—8 FIG. 2.

In the modification of FIGS. 10 and 11, blade guide, generally designated 12' has single side wall 14', having a slot 22', lug 30' and cut-out 34'. In this embodiment, the inner wall of opposing housing 4 functions as the second blade guide side wall when blade guide 12' is in place in the assembled housing and the knife is in use. The omission of the second blade guide side wall reduces the cost of the guide.

Figure 12:
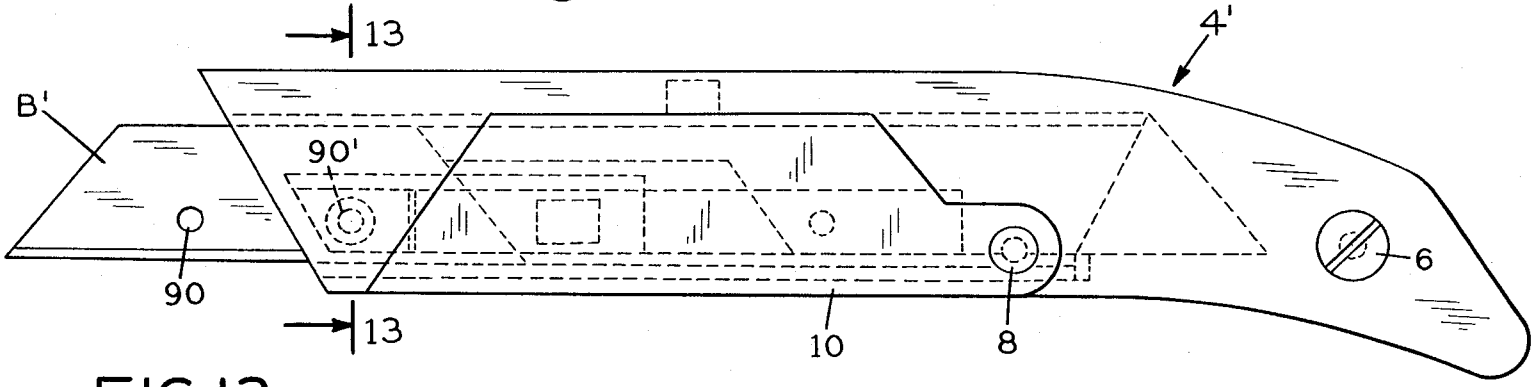
FIG. 12 is a side view of an embodiment of the knife of FIG. 1 and showing a modified lock.
Figure 14:
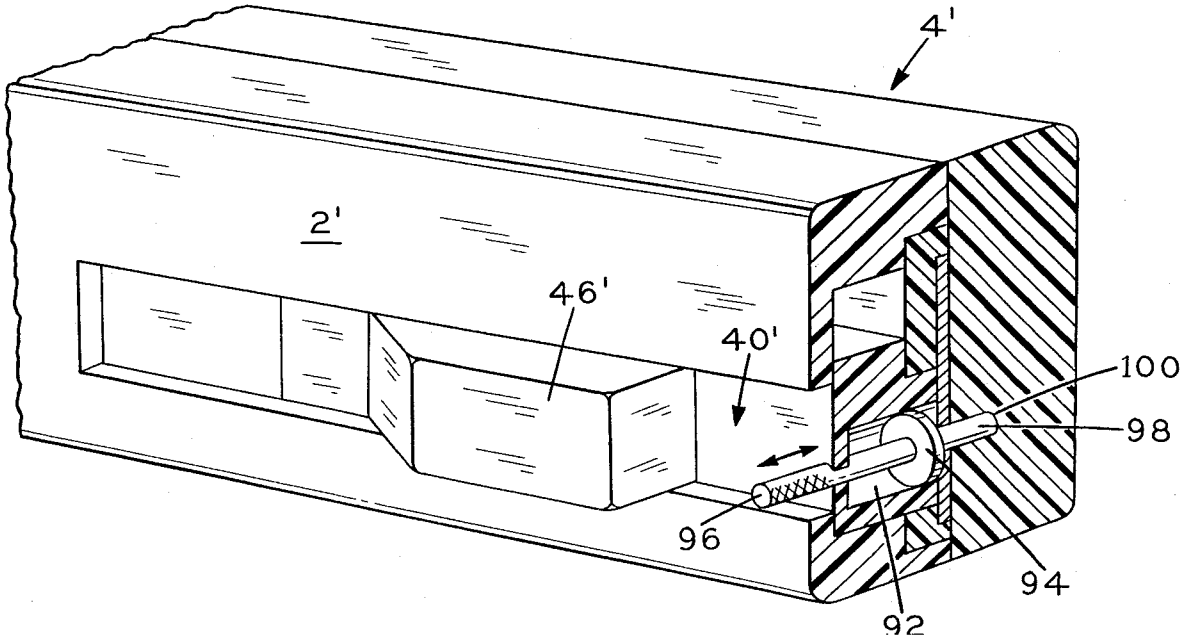
FIG. 14 is an enlarged view, in perspective, of the modified lock of FIGS. 12 and 13.
Figure 13:
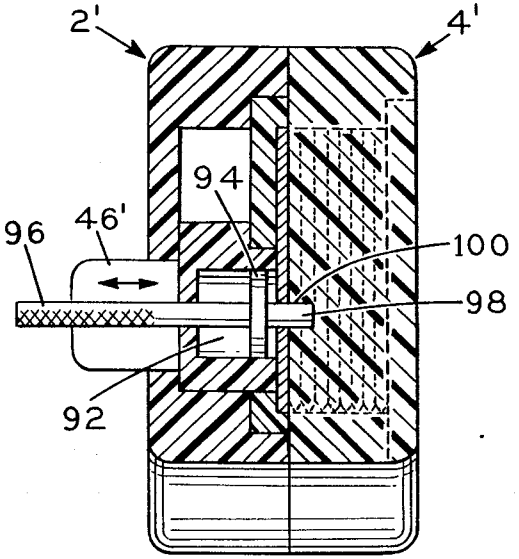
FIG. 13 is a sectional view taken at 13—13 FIG. 12.

In the modification of FIGS. 12, 13, and 14, knife blade B' is provided with spaced locking holes 90, 90'. Blade slide 40' is provided with a chamber 92 located forward of handle 46', having a plunger 94 having at one side a handle 96 and at its other side a pin 98. Plunger 94 is metal, and is held firmly in an advanced or retracted position within chamber 92 due to magnetic forces of blade slide 40'. Handle part 4' has a hole 100 in alignment with pin 98 when blade slide 40' is advanced to its most forward (blade lock) position. Thus, when blade B' is in position with blade hole 90 or 90' aligned with pin 98 and hole 100, plunger 94 is advanced locking the blade in position. To retract or remove the locked blade, plunger 94 is withdrawn by handle 96 until pin 98 is free of hole 100 and blade hole 90 or 90', as the case may be. Blade B' may then be retracted or removed in the manner aforestated. The location of chamber 92, plunger 94 and hole 100 might be reversed so that the chamber and plunger are in handle part 4' and hole 100 in slide 40'.

The operations of the knives of the modifications of FIGS. 10–14, incl., are the same as the operation of the knife of FIGS. 1–13.

The terms and expressions which have been employed are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A utility knife having a handle, a recess in the handle for receiving a stack of knife blades, a knife blade guide in said handle parallel to said recess for receiving a knife blade from said recess, said guide having an opening in one wall thereof for guiding a received knife blade from said recess to a knife end of said handle, magnetic means for attracting at least an innermost blade of said stack of knife blades into alignment with said knife blade guide and for holding said innermost blade in such alignment, and follower means slidable in said handle parallel to said blade guide, means for sliding said follower means in said blade guide, said follower means including means for engaging and sliding said innermost blade of said stack of knife blades in said handle along said knife blade guide and for projecting the end of said innermost blade at the knife end of said handle and means for locking the blade in a projected position in said handle.

2. A utility knife, as recited in claim 1, in which said locking means includes means for releasing said locking means from said engaged and projected blade so that said blade can be retracted into said handle by said follower means or can be removed and ejected from said handle.

3. A utility knife, as recited in claim 2, in which said locking means includes a slide movable longitudinally of said handle for locking and releasing said blade.

4. A utility knife, as recited in claim 2, in which said locking means includes a slide movable longitudinally of said handle and a lock movable vertically in said handle into and out of engagement with said blade in said guide, said longitudinally movable slide engaging and vertically moving said lock to engage and disengage said blade as said slide is moved longitudinally.

* * * * *

REEXAMINATION CERTIFICATE (974th)

United States Patent [19] [11] B1 4,517,741

Castelluzzo [45] Certificate Issued Dec. 27, 1988

[54] KNIFE WITH PLURAL REPLACEABLE BLADE STORAGE AND MEANS FOR SINGLE BLADE EXTENSION

[76] Inventor: James M. Castelluzzo, 188 Avenue of the Americas, New York, N.Y. 10013

Reexamination Request:
No. 90/001,374, Nov. 12, 1987

Reexamination Certificate for:

| | |
|---|---|
| Patent No.: | **4,517,741** |
| Issued: | **May 21, 1985** |
| Appl. No.: | **379,900** |
| Filed: | **May 19, 1982** |

[51] Int. Cl.[4] ..... B26B 21/04; B26B 1/08
[52] U.S. Cl. ..... 30/162; 30/335; 221/212
[58] Field of Search ..... 30/40, 40.2, 151, 154, 30/162, 163, 293, 329, 335; 221/29, 212, 232, 236

[56] References Cited

U.S. PATENT DOCUMENTS

| | | | |
|---|---|---|---|
| 2,172,072 | 9/1939 | Rothschild | 30/335 |
| 2,643,579 | 6/1953 | Jacoby, Jr. | 83/700 |
| 2,698,110 | 12/1954 | DiRenna | 221/212 |
| 2,967,354 | 1/1961 | Ahlborn | 30/393 |
| 3,577,637 | 5/1971 | Braginetz | 30/162 |
| 3,660,896 | 5/1972 | Umholtz | 30/162 |
| 3,708,881 | 1/1973 | Bennett | 30/335 |
| 4,005,525 | 2/1977 | Gringer | 30/335 |
| 4,242,295 | 1/1981 | Rollband | 30/162 |
| 4,277,888 | 7/1981 | Szabo | 30/162 |

*Primary Examiner*—Douglas D. Watts

[57] ABSTRACT

A knife having generally thin, relatively inexpensive and replaceable blades which can be extended from the handle when the knife is to be used and can be retracted when the knife is to be stored, the knife having a cavity in the handle for receiving a stack of the blades, a slide having a magnetic face for engaging and sliding the innermost blade into extended position and for retracting the blade into the handle and a lock for locking the blade extended.

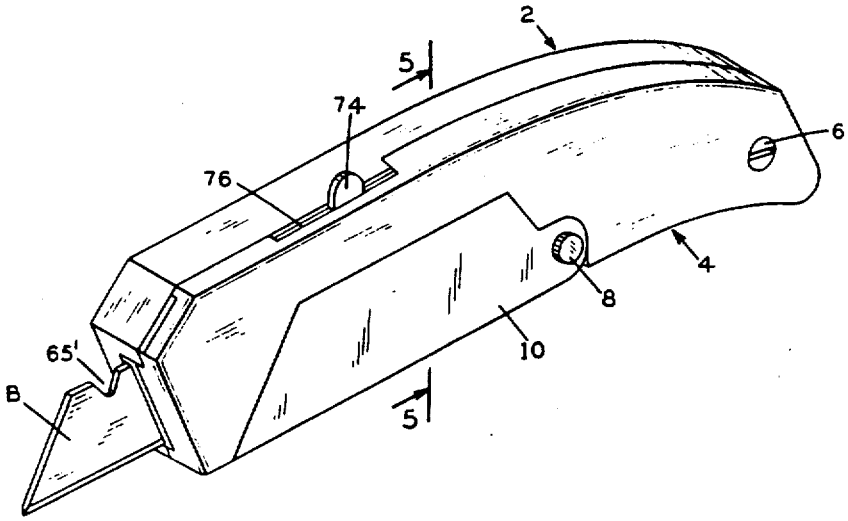

EEXAMINATION CERTIFICATE ISSUED UNDER 35 U.S.C. 307

) AMENDMENTS HAVE BEEN MADE TO THE PATENT

AS A RESULT OF REEXAMINATION, IT HAS BEEN DETERMINED THAT:

The patentability of claims 1–4 is confirmed.

* * * * *